US009230512B2

(12) United States Patent
Zhang

(10) Patent No.: US 9,230,512 B2
(45) Date of Patent: Jan. 5, 2016

(54) LED BACKLIGHT DRIVING CIRCUIT AND LIQUID CRYSTAL DEVICE

(71) Applicant: Shenzhen China Star Optoelectronics Technology Co., Ltd., Shenzhen, Guangdong (CN)

(72) Inventor: Xianming Zhang, Shenzhen (CN)

(73) Assignee: Shenzhen China Star Optoelectronics Technoogy Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 14/346,962

(22) PCT Filed: Jan. 15, 2014

(86) PCT No.: PCT/CN2014/070672

§ 371 (c)(1),
(2) Date: Mar. 24, 2014

(87) PCT Pub. No.: WO2015/100804

PCT Pub. Date: Jul. 9, 2015

(65) Prior Publication Data

US 2015/0189716 A1 Jul. 2, 2015

(51) Int. Cl.

| | |
|---|---|
| ***H05B 37/02*** | (2006.01) |
| ***G09G 5/10*** | (2006.01) |
| ***H05B 33/08*** | (2006.01) |
| ***G09G 3/36*** | (2006.01) |

(52) U.S. Cl.

CPC .. *G09G 5/10* (2013.01); *G09G 3/36* (2013.01); *H05B 33/0815* (2013.01); *H05B 37/02* (2013.01)

(58) Field of Classification Search

CPC ..... H05B 37/02; H05B 33/08

USPC ..... 315/185 R, 186, 192, 224, 294, 297, 307

See application file for complete search history.

(56) References Cited

U.S. PATENT DOCUMENTS

| | | | | |
|---|---|---|---|---|
| 2004/0251854 | A1* | 12/2004 | Matsuda et al. | 315/291 |
| 2011/0074310 | A1* | 3/2011 | Nakada et al. | 315/291 |
| 2011/0127923 | A1* | 6/2011 | Lin et al. | 315/193 |
| 2012/0248997 | A1* | 10/2012 | Jung | H05B 33/0815 315/192 |
| 2013/0069545 | A1* | 3/2013 | Seo et al. | 315/186 |
| 2014/0077719 | A1* | 3/2014 | Fukuda | H05B 33/08 315/224 |

FOREIGN PATENT DOCUMENTS

| | | |
|---|---|---|
| CN | 201550321 U | 8/2010 |

* cited by examiner

*Primary Examiner* — Tung X Le
(74) *Attorney, Agent, or Firm* — Andrew C. Cheng

(57) ABSTRACT

A LED backlight driving circuit is disclosed. The LED backlight driving circuit includes a boost circuit for converting an input voltage to an output voltage for a LED unit, a driving IC for controlling the boost circuit such that the boost circuit converts the input voltage to the output voltage for the LED unit, a discharging module for releasing charges stored within the boost circuit after the driving circuit is turned off, and a detecting module for detecting a voltage at an output end of the boost circuit and then for generating enable signals for controlling the operations of the driving IC. The LED backlight driving circuit is capable of detecting a discharging state of the boost circuit after being quickly rebooted. The driving circuit can be rebooted only if the output voltage is smaller than a reference voltage as the charges stored within the boost circuit is released. As such, the flashing issue is avoided. In addition, the liquid crystal device including the above LED backlight driving circuit is also disclosed.

11 Claims, 2 Drawing Sheets

LED BACKLIGHT DRIVING CIRCUIT AND LIQUID CRYSTAL DEVICE

BACKGROUND OF THE INVENTION

1. Field of the Invention

The present disclosure relates to LED backlight driving circuit technology, and more particularly to a LED backlight driving circuit capable of quick rebooting without resulting in flashing, and the liquid crystal device (LCD) with the same.

2. Discussion of the Related Art

With the technology revolution, backlight technology of LCDs has been developed. Typical LCDs adopt cold cathode fluorescent lamps (CCFL) as the backlight sources. However, as the CCFL backlight is characterized by attributes including low color reduction ability, low lighting efficiency, high discharging voltage, bad discharging characteristics in low temperature, and also, the CCFL needs a long time to achieve a stable gray scale, LED backlight source is a newly developed technology. For LCDs, the LED backlight source is arranged opposite to the liquid crystal panel so as to provide the light source to the liquid crystal panel. The LED backlight source includes at least one LED string, and each LED string includes a plurality of LEDs serially connected.

Generally, an output capacitor is arranged within the power supplying module of the driving circuit of the LED backlight source. During a quick reboot process, as charges are stored on the capacitor, the driving circuit may flash upon rebooting. FIG. 1 is a connecting module diagram of a typical LED backlight driving circuit having a discharging module.

As shown in FIG. 1, the LED backlight source driving circuit includes a boost circuit 110, a LED unit 120, and a driving IC 130. The boost circuit 110 is controlled by the driving IC 130 to convert the input voltage (Vin) to a needed output voltage (Vout) for the LED unit 120. In order to solve the flashing issue during the quick reboot process, the output end of the boost circuit 110 connects to one discharging module 140 for releasing the charges stored within the boost circuit 110 after the driving circuit is turned off. For this kind of circuit, when the time gap between the quick reboot process is small, the charges stored within the boost circuit 110 may have not been totally released, which may result in flashing after the driving circuit is rebooted.

SUMMARY

In view of the above, the LED backlight driving circuit is capable of detecting a discharging state of the boost circuit. The driving circuit can be reboot only if the output voltage is smaller than a predetermined voltage as the charges stored within the boost circuit is released.

In one aspect, a LED backlight driving circuit includes: a boost circuit for converting an input voltage to an output voltage for a LED unit; a driving IC for controlling the boost circuit such that the boost circuit converts the input voltage to the output voltage for the LED unit; a discharging module for releasing charges stored within the boost circuit after the driving circuit is turned off; and a detecting module for detecting a voltage at an output end of the boost circuit and then for generating an enable signals connecting to the driving IC, the driving IC begins operations when the enable signals are at high level, and the driving IC stops operations when the enable signals are at low level.

Wherein one reference voltage is configured within the detecting module, the detecting module generates the enable signals at low level when the voltage at the output end of the boost circuit is larger than or equal to the reference voltage, and the detecting module generates the enable signals at high level when the voltage at the output end of the boost circuit is smaller than the reference voltage.

Wherein the detecting module includes a turn-on module for generating enabling signals and a switch module, the switch module is controlled by the enabling signals, the switch module is turned on when the enabling signals are at low level and the detecting module begins to detect the voltage at the output end of the boost circuit, the switch module is turned off when the enabling signals are at high level and the detecting module stops detecting the voltage at the output end of the boost circuit.

Wherein the switch module includes a third MOS transistor and a fourth MOS transistor, a gate of the third MOS transistor connects with the enable signal, a source of the third MOS transistor is grounded, a drain of the third MOS transistor connects to one end of the fifth resistor, and the other end of the fifth resistor connects to a switch voltage, the gate of the fourth MOS transistor connects to a drain of the third MOS transistor, the source of the fourth MOS transistor is grounded via the fourth resistor, the drain of the fourth MOS transistor connects to the output end of the boost circuit via the third resistor; and the turn-on module includes a second MOS transistor, the gate of the second MOS transistor connects to the source of the fourth MOS transistor, the source of the second MOS transistor is grounded, the drain of the second MOS transistor connects to one end of the sixth resistor, and the other end of the sixth resistor connects to a turn-on voltage, wherein the drain of the second MOS transistor operates as the output end of the enable signals, the gate of the second MOS transistor further connects to a second capacitor, and the other end of the second capacitor is grounded.

Wherein the third resistor and the fourth resistor are variable resistors.

Wherein the boost circuit further includes an inductor, a first MOS transistor, a rectifier diode, and a first capacitor, one end of the inductor is for receiving the input DC voltage, and the other end of the inductor connects to a positive end of the rectifier diode, a negative end of the rectifier diode connects to a positive end of the LED unit, the drain of the first MOS transistor connects to the positive end of the rectifier diode, the source of the first MOS transistor is electrically grounded, the gate of the first MOS transistor connects to the driving IC, one end of the first capacitor connects to the negative end of the rectifier diode, and the other end of the first capacitor is electrically grounded.

Wherein The LED unit includes a plurality of LED strings connected in parallel, and each of the LED strings includes a plurality of LEDs serially connected.

Wherein the discharging module includes a second resistor, one end of the second resistor connects to the output end of the boost circuit, and the other end of the second resistor is grounded.

Wherein the discharging module includes a plurality of resistors connected in parallel, and one end of the resistors connected in parallel connects to the output end of the boost circuit, and the other end of the resistors connected in parallel is grounded.

In another aspect, a liquid crystal device includes a LED backlight source. A driving circuit of the LED backlight source includes: a boost circuit for converting an input voltage to an output voltage for a LED unit; a driving IC for controlling the boost circuit such that the boost circuit converts the input voltage to the output voltage for the LED unit; a discharging module for releasing charges stored within the boost circuit after the driving circuit is turned off; and a detecting module for detecting a voltage at an output end of the boost circuit and then for generating an enable signals connecting to the driving IC, the driving IC begins operations when the enable signals are at high level, and the driving IC stops operations when the enable signals are at low level.

Wherein one reference voltage is configured within the detecting module, the detecting module generates the enable signals at low level when the voltage at the output end of the boost circuit is larger than or equal to the reference voltage, and the detecting module generates the enable signals at high level when the voltage at the output end of the boost circuit is smaller than the reference voltage.

Wherein the detecting module includes a turn-on module for generating enabling signals and a switch module, the switch module is controlled by the enabling signals, the switch module is turned on when the enabling signals are at low level and the detecting module begins to detect the voltage at the output end of the boost circuit, the switch module is turned off when the enabling signals are at high level and the detecting module stops detecting the voltage at the output end of the boost circuit.

Wherein the switch module includes a third MOS transistor and a fourth MOS transistor, a gate of the third MOS transistor connects with the enable signal, a source of the third MOS transistor is grounded, a drain of the third MOS transistor connects to one end of the fifth resistor, and the other end of the fifth resistor connects to a switch voltage, the gate of the fourth MOS transistor connects to a drain of the third MOS transistor, the source of the fourth MOS transistor is grounded via the fourth resistor, the drain of the fourth MOS transistor connects to the output end of the boost circuit via the third resistor; and the turn-on module includes a second MOS transistor, the gate of the second MOS transistor connects to the source of the fourth MOS transistor, the source of the second MOS transistor is grounded, the drain of the second MOS transistor connects to one end of the sixth resistor, and the other end of the sixth resistor connects to a turn-on voltage, wherein the drain of the second MOS transistor operates as the output end of the enable signals, the gate of the second MOS transistor further connects to a second capacitor, and the other end of the second capacitor is grounded.

Wherein the third resistor and the fourth resistor are variable resistors.

Wherein the boost circuit further includes an inductor, a first MOS transistor, a rectifier diode, and a first capacitor, one end of the inductor is for receiving the input DC voltage, and the other end of the inductor connects to a positive end of the rectifier diode, a negative end of the rectifier diode connects to a positive end of the LED unit, the drain of the first MOS transistor connects to the positive end of the rectifier diode, the source of the first MOS transistor is electrically grounded, the gate of the first MOS transistor connects to the driving IC, one end of the first capacitor connects to the negative end of the rectifier diode, and the other end of the first capacitor is electrically grounded.

Wherein the discharging module includes a second resistor, one end of the second resistor connects to the output end of the boost circuit, and the other end of the second resistor is grounded.

Wherein the discharging module includes a plurality of resistors connected in parallel, and one end of the resistors connected in parallel connects to the output end of the boost circuit, and the other end of the resistors connected in parallel is grounded.

In view of the above, the output end of the boost circuit connects to the detecting module. When the driving circuit reboots after being turned off, the detecting module is capable of detecting the discharging state of the boost circuit. When the output voltage is smaller than the predetermined voltage for the reason that the charges stored within the boost circuit is released, the driving circuit can be turn on. As such, the driving circuit is prevented from flashing in the quick reboot process.

DETAILED DESCRIPTION OF THE EMBODIMENTS

Embodiments of the invention will now be described more fully hereinafter with reference to the accompanying drawings, in which embodiments of the invention are shown.

Figure 1:
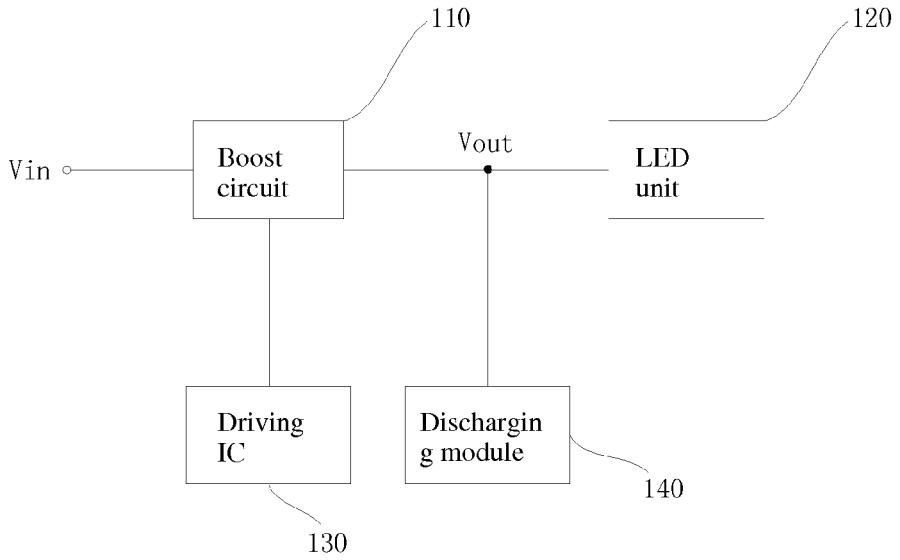
Fig. 1 (prior art)
FIG. 1 is a connecting module diagram of a typical LED backlight driving circuit having a discharging module.
Figure 2:
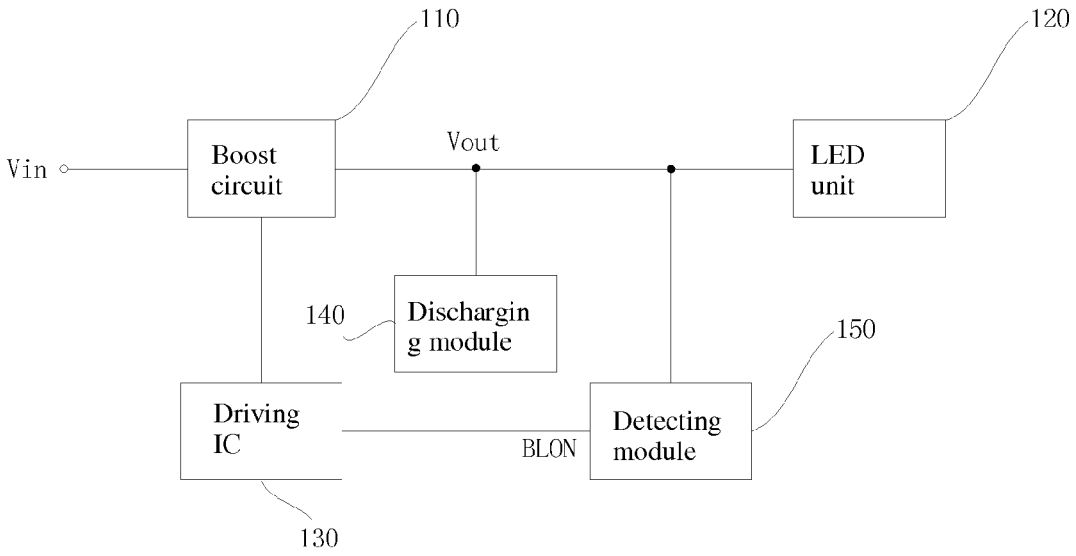
FIG. 2 is a connecting module diagram of a LED backlight driving circuit in accordance with one embodiment.

FIG. 2 is a connecting module diagram of a LED backlight driving circuit in accordance with one embodiment.

As shown in FIG. 2, the LED backlight driving circuit includes a boost circuit 110, a LED unit 120, a driving IC 130, a discharging module 140, and a detecting module 150. The boost circuit 110 converts the input voltage (Vin) to the output voltage (Vout) for the LED unit 120. The driving IC 130 controls the boost circuit 110 such that the boost circuit 110 converts the input voltage (Vin) to the output voltage (Vout) for the LED unit 120. The discharging module 140 is for releasing the charges stored within the boost circuit 110 after the driving circuit is turned off. The detecting module 150 detects a voltage at an output end of the boost circuit 110 and then generates enable signals connecting to the driving IC 130. When the enable signals are at high level, the driving IC 130 begins its operation, and when the enable signals are at low level, the driving IC 130 stops its operation.

One reference voltage is configured within the detecting module 150. The detecting module 150 generates the enable signals at low level when the voltage at the output end of the boost circuit 110 is larger than or equal to the reference voltage. The detecting module 150 generates the enable signals at high level when the voltage at the output end of the boost circuit 110 is smaller than the reference voltage.

Figure 3:
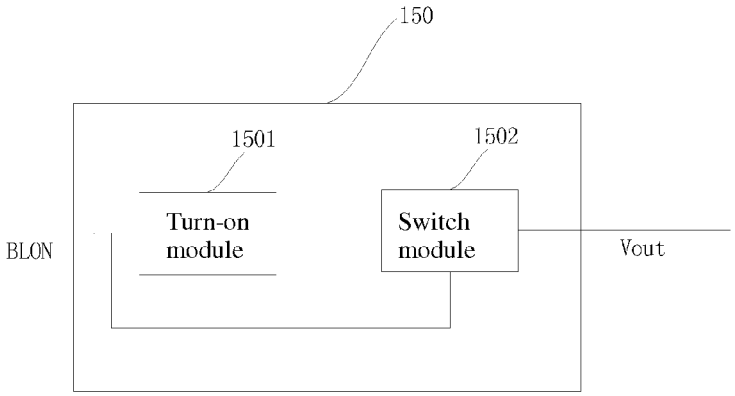
FIG. 3 is a connecting module diagram of the detecting module of the LED backlight driving circuit of FIG. 2.

FIG. 3 is a connecting module diagram of the detecting module of the LED backlight driving circuit of FIG. 2. The detecting module 150 includes a turn-on module 1501 for generating enabling signals and a switch module 1502. The switch module 1502 is controlled by the enabling signals. When the enabling signals are at low level, the switch module 1502 is turned on, and then the detecting module 150 begins to detect the voltage at the output end of the boost circuit 110. When the enabling signals are at high level, the switch module 1502 is turned off, and then the detecting module 150 stops detecting the voltage at the output end of the boost circuit 110.

Figure 4:
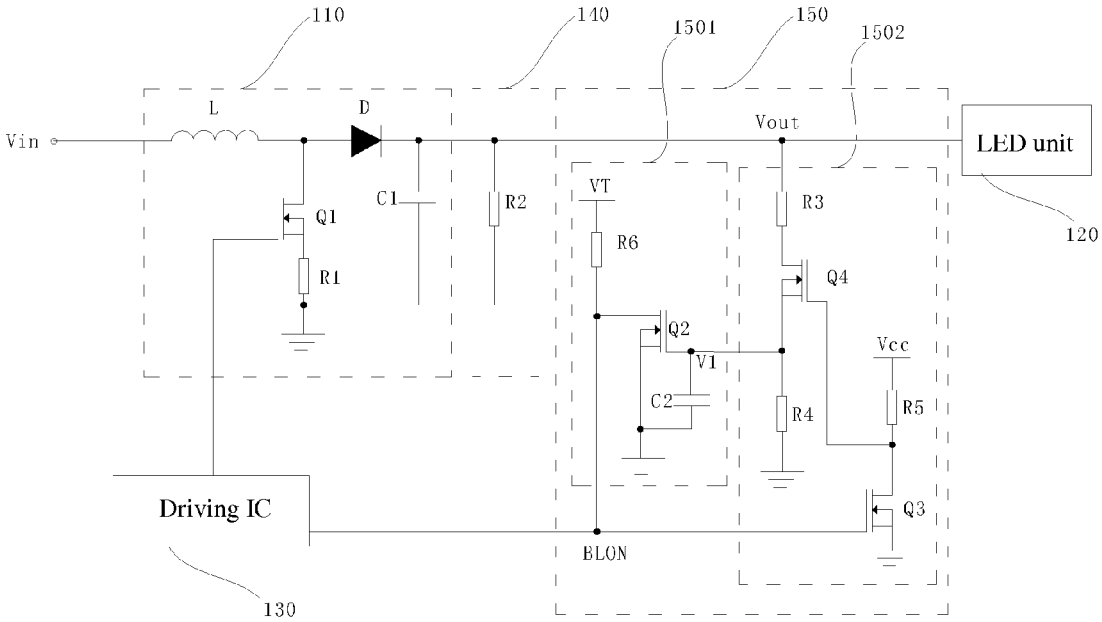
FIG. 4 is a circuit diagram of the LED backlight driving circuit in accordance with one embodiment.

FIG. 4 is a circuit diagram of the LED backlight driving circuit in accordance with one embodiment.

As shown in FIG. 4, the LED backlight driving circuit includes the boost circuit 110, the LED unit 120, the driving IC 130, the discharging module 140, and the detecting module 150.

The boost circuit 110 further includes an inductor (L), a first MOS transistor (Q1), a rectifier diode (D), and a first capacitor (C1). One end of the inductor (L) is for receiving the input DC voltage (Vin), and the other end of the inductor (L) connects to a positive end of the rectifier diode (D). A negative end of the rectifier diode (D) connects to the positive end of the LED unit 120 to provide the output voltage (Vout). The drain of the first MOS transistor (Q1) connects to the positive end of the rectifier diode (D), the source of the first MOS transistor (Q1) is electrically grounded via the first resistor (R1). The gate of the first MOS transistor (Q1) connects to the driving IC 130. The driving IC 130 controls the first MOS transistor (Q1) to turn on or off so as to control the operations of the boost circuit 110. One end of the first capacitor (C1) connects to the negative end of the rectifier diode (D), and the other end of the first capacitor (C1) is electrically grounded. The first capacitor (C1) operates as the output capacitor of the boost circuit 110.

The LED unit 120 includes a plurality of LED strings connected in parallel, and each of the LED strings includes a plurality of LEDs serially connected.

The discharging module 140 includes a second resistor (R2). One end of the second resistor (R2) connects to the output end of the boost circuit 110, and the other end of the second resistor (R2) is grounded. That is, the second resistor (R2) and the first capacitor (C1) of the boost circuit 110 are connected in parallel and are grounded. The first capacitor (C1) discharges via the second resistor (R2). In the embodiment, the discharging module only includes one resistor operating as the discharging resistor. In other embodiments, the discharging resistors include a plurality of resistors connected in parallel.

The detecting module 150 includes the turn-on module 1501 and the switch module 1502. The turn-on module 1501 generates the enable signals (BLON) connecting to the driving IC 130. When the enable signals (BLON) are at high level, the driving IC 130 begins its operation. When the enable signals (BLON) are at low level, the driving IC 130 stops its operation.

The switch module 1502 includes a third MOS transistor (Q3) and a fourth MOS transistor (Q4). The gate of the third MOS transistor (Q3) connects with the enable signals (BLON). The source of the third MOS transistor (Q3) is grounded. The drain of the third MOS transistor (Q3) connects to one end of the fifth resistor (R5), and the other end of the fifth resistor (R5) connects to a switch voltage (Vcc). The gate of the fourth MOS transistor (Q4) connects to the drain of the third MOS transistor (Q3). The source of the fourth MOS transistor (Q4) is grounded via the fourth resistor (R4). The drain of the fourth MOS transistor (Q4) connects to the output end of the boost circuit 110 via the third resistor (R3). When the enable signals (BLON) are at low level, the third MOS transistor (Q3) is turned off and the fourth MOS transistor (Q4) is turned on. At this moment, the detecting module 150 detects the voltage at the output end of the boost circuit 110. When the fourth MOS transistor (Q4) are at high level, the third MOS transistor (Q3) is turned on and the fourth MOS transistor (Q4) is turned off. At this moment, the detecting module 150 is not able to detect the voltage at the output end of the boost circuit 110.

The turn-on module 1501 includes the second MOS transistor (Q2). The gate of the second MOS transistor (Q2) connects to the source of the fourth MOS transistor (Q4). The source of the second MOS transistor (Q2) is grounded. The drain of the second MOS transistor (Q2) connects to one end of the sixth resistor (R6), and the other end of the sixth resistor (R6) connects to a turn-on voltage (VT). The drain of the second MOS transistor (Q2) operates as the output end of the enable signals (BLON). The gate of the second MOS transistor (Q2) further connects to a second capacitor (C2), and the other end of the second capacitor (C2) is grounded. The turn-on voltage (VT) operates as the turn-on signals of the LED backlight driving circuit. When the turn-on voltage (VT) are at high level, the LED backlight driving circuit is turned on. When the turn-on voltage (VT) are at low level, the LED backlight driving circuit is turned off. The enable signals (BLON) outputted by the turn-on module 1501 is changed upon the second MOS transistor (Q2) is turned on or turn off. The switch voltage (V1) of the second MOS transistor (Q2) may be referenced by a predetermined reference voltage of the detecting module 150. The reference voltage is $$V1 * \frac{R3 + R4}{R4}.$$

The operating process of the LED backlight driving circuit of FIG. 4 will be described in detail hereinafter.

In step (a), when the driving circuit is turned on for the first time, that is, the VT are at high level, the enable signals (BLON) are at high level. The driving IC 130 begins its operations to turn on the LED backlight driving circuit. At this moment, the third MOS transistor (Q3) is turned on, and the fourth MOS transistor (Q4) is turned off. The second MOS transistor (Q2) is turned off, and the detecting module 150 is not able to detect the voltage at the output end of the boost circuit 110.

In step (b), when the driving circuit is turned off, that is, the turn-on voltage (VT) are at low level, the driving IC 130 stops its operation and the LED backlight driving circuit is turned off. The first capacitor (C1) of the boost circuit 110 discharges via the second resistor (R2). At this moment, the third MOS transistor (Q3) is turned off, and the fourth MOS transistor (Q4) is turned on. The detecting module 150 is capable of detecting the voltage at the output end of the detecting module 150. At this moment, the gate voltage of the second MOS transistor (Q2) is controlled to be $$V\text{out} * \frac{R4}{R3 + R4}$$

by the output voltage (Vout) at two ends of the first capacitor (C1) via a voltage divider loop of the third resistor (R3) and the fourth resistor (R4). It is to be noted that $$V\text{out} * \frac{R4}{R3 + R4}$$

is larger than the switch voltage (V1) in the initial discharging process. The second MOS transistor (Q2) is turned on and charges the second capacitor (C2).

In step (c), when the driving circuit is quickly rebooted, the turn-on voltage (VT) are at high level. At this moment, if the first capacitor (C1) has not been totally discharged, the output voltage (Vout) is still larger than or equal to the reference voltage and the voltage at two ends of the second capacitor (C2) is larger than the switch voltage (V1) of the second MOS transistor (Q2). The second MOS transistor (Q2) is turned on, and the source of the second MOS transistor (Q2) are at low level. That is, the enable signals (BLON) at low level is outputted to stop the operations of the driving IC 130, and the LED backlight driving circuit is not turned on. If the first capacitor (C1) of the boost circuit 110 discharges and causes the output voltage (Vout) be smaller than the reference voltage, which means the flashing is avoided, the voltage at two ends of the second capacitor (C2) is smaller than the switch voltage (V1) of the second MOS transistor (Q2). The second MOS transistor (Q2) is turned off, and the source of the second MOS transistor (Q2) are at high level. That is, the enable signals (BLON) at high level is outputted and the driving IC 130 begins its operations such that the LED backlight driving circuit is turned on. At this moment, the third MOS transistor (Q3) is turned on and the fourth MOS transistor (Q4) is turned off. The detecting module 150 is unable to detect the voltage at the output ends of the boost circuit 110 and then enters the state of the step (a).

By changing the resistance of the third resistor (R3) and the fourth resistor (R4), the reference voltage is adjusted. Thus, in some embodiments, the third resistor (R3) and the fourth resistor (R4) may be variable resistors.

In view of the above, the output end of the boost circuit connects to the detecting module. When the driving circuit reboots after being turned off, the detecting module is capable of detecting the discharging state of the boost circuit. When the output voltage is smaller than the predetermined voltage for the reason that the charges stored within the boost circuit is released, the driving circuit can be turn on. As such, the driving circuit is prevented from flashing in the quick reboot process.

It should be noted that the relational terms herein, such as "first" and "second", are used only for differentiating one entity or operation, from another entity or operation, which, however do not necessarily require or imply that there should be any real relationship or sequence. Moreover, the terms "comprise", "include" or any other variations thereof are meant to cover non-exclusive including, so that the process, method, article or device comprising a series of elements do not only comprise those elements, but also comprise other elements that are not explicitly listed or also comprise the inherent elements of the process, method, article or device. In the case that there are no more restrictions, an element qualified by the statement "comprises a . . . " does not exclude the presence of additional identical elements in the process, method, article or device that comprises the said element.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A LED backlight driving circuit, comprising:

a boost circuit for converting an input voltage to an output voltage for a LED unit;

a driving IC for controlling the boost circuit such that the boost circuit converts the input voltage to the output voltage for the LED unit;

a discharging module for releasing charges stored within the boost circuit after the driving circuit is turned off; and a detecting module for detecting a voltage at an output end of the boost circuit and then for generating an enable signals connecting to the driving IC, the driving IC begins operations when the enable signals are at high level, and the driving IC stops operations when the enable signals are at low level;

wherein one reference voltage is configured within the detecting module, the detecting module generates the enable signals at low level when the voltage at the output end of the boost circuit is larger than or equal to the reference voltage, and the detecting module generates the enable signals at high level when the voltage at the output end of the boost circuit is smaller than the reference voltage; and wherein the detecting module comprises a turn-on module for generating enabling signals and a switch module, the switch module is controlled by the enabling signals, the switch module is turned on when the enabling signals are at low level and the detecting module begins to detect the voltage at the output end of the boost circuit, the switch module is turned off when the enabling signals are at high level and the detecting module stops detecting the voltage at the output end of the boost circuit.

2. The LED backlight driving circuit as claimed in claim 1, wherein the switch module comprises a third MOS transistor and a fourth MOS transistor, a gate of the third MOS transistor connects with the enable signal, a source of the third MOS transistor is grounded, a drain of the third MOS transistor connects to one end of the fifth resistor, and the other end of the fifth resistor connects to a switch voltage, the gate of the fourth MOS transistor connects to a drain of the third MOS transistor, the source of the fourth MOS transistor is grounded via the fourth resistor, the drain of the fourth MOS transistor connects to the output end of the boost circuit via the third resistor; and the turn-on module comprises a second MOS transistor, the gate of the second MOS transistor connects to the source of the fourth MOS transistor, the source of the second MOS transistor is grounded, the drain of the second MOS transistor connects to one end of the sixth resistor, and the other end of the sixth resistor connects to a turn-on voltage, wherein the drain of the second MOS transistor operates as the output end of the enable signals, the gate of the second MOS transistor further connects to a second capacitor, and the other end of the second capacitor is grounded.

3. The LED backlight driving circuit as claimed in claim 2, wherein the third resistor and the fourth resistor are variable resistors.

4. The LED backlight driving circuit as claimed in claim 2, wherein the boost circuit further comprises an inductor, a first MOS transistor, a rectifier diode, and a first capacitor, one end of the inductor is for receiving the input DC voltage, and the other end of the inductor connects to a positive end of the rectifier diode, a negative end of the rectifier diode connects to a positive end of the LED unit, the drain of the first MOS transistor connects to the positive end of the rectifier diode, the source of the first MOS transistor is electrically grounded, the gate of the first MOS transistor connects to the driving IC, one end of the first capacitor connects to the negative end of the rectifier diode, and the other end of the first capacitor is electrically grounded.

5. The LED backlight driving circuit as claimed in claim 1, wherein The LED unit comprises a plurality of LED strings connected in parallel, and each of the LED strings comprises a plurality of LEDs serially connected.

6. The LED backlight driving circuit as claimed in claim 1, wherein the discharging module comprises a second resistor, one end of the second resistor connects to the output end of the boost circuit, and the other end of the second resistor is grounded.

7. A liquid crystal device having a LED backlight source, a driving circuit of the LED backlight source comprising:

a boost circuit for converting an input voltage to an output voltage for a LED unit;

a driving IC for controlling the boost circuit such that the boost circuit converts the input voltage to the output voltage for the LED unit;

a discharging module for releasing charges stored within the boost circuit after the driving circuit is turned off; and a detecting module for detecting a voltage at an output end of the boost circuit and then for generating an enable signals connecting to the driving IC, the driving IC begins operations when the enable signals are at high level, and the driving IC stops operations when the enable signals are at low level;

wherein one reference voltage is configured within the detecting module, the detecting module generates the enable signals at low level when the voltage at the output end of the boost circuit is larger than or equal to the reference voltage, and the detecting module generates the enable signals at high level when the voltage at the output end of the boost circuit is smaller than the reference voltage; and wherein the detecting module comprises a turn-on module for generating enabling signals and a switch module, the switch module is controlled by the enabling signals, the switch module is turned on when the enabling signals are at low level and the detecting module begins to detect the voltage at the output end of the boost circuit, the switch module is turned off when the enabling signals are at high level and the detecting module stops detecting the voltage at the output end of the boost circuit.

8. The liquid crystal device as claimed in claim 7, wherein the switch module comprises a third MOS transistor and a fourth MOS transistor, a gate of the third MOS transistor connects with the enable signal, a source of the third MOS transistor is grounded, a drain of the third MOS transistor connects to one end of the fifth resistor, and the other end of the fifth resistor connects to a switch voltage, the gate of the fourth MOS transistor connects to a drain of the third MOS transistor, the source of the fourth MOS transistor is grounded via the fourth resistor, the drain of the fourth MOS transistor connects to the output end of the boost circuit via the third resistor; and the turn-on module comprises a second MOS transistor, the gate of the second MOS transistor connects to the source of the fourth MOS transistor, the source of the second MOS transistor is grounded, the drain of the second MOS transistor connects to one end of the sixth resistor, and the other end of the sixth resistor connects to a turn-on voltage, wherein the drain of the second MOS transistor operates as the output end of the enable signals, the gate of the second MOS transistor further connects to a second capacitor, and the other end of the second capacitor is grounded.

9. The liquid crystal device as claimed in claim 8, wherein the third resistor and the fourth resistor are variable resistors.

10. The liquid crystal device as claimed in claim 8, wherein the boost circuit further comprises an inductor, a first MOS transistor, a rectifier diode, and a first capacitor, one end of the inductor is for receiving the input DC voltage, and the other end of the inductor connects to a positive end of the rectifier diode, a negative end of the rectifier diode connects to a positive end of the LED unit, the drain of the first MOS transistor connects to the positive end of the rectifier diode, the source of the first MOS transistor is electrically grounded, the gate of the first MOS transistor connects to the driving IC, one end of the first capacitor connects to the negative end of the rectifier diode, and the other end of the first capacitor is electrically grounded.

11. The liquid crystal device as claimed in claim 7, wherein the discharging module comprises a second resistor, one end of the second resistor connects to the output end of the boost circuit, and the other end of the second resistor is grounded.

* * * * *